US006942039B2

(12) United States Patent
Tinker

(10) Patent No.: US 6,942,039 B2
(45) Date of Patent: Sep. 13, 2005

(54) FLAPPER VALVE AND ASSOCIATED METHOD FOR SINGLE TRIP RETRIEVAL OF PACKER TOOLS

(75) Inventor: Donald W. Tinker, Rapid City, MI (US)

(73) Assignee: Team Oil Tools, LLC, Tulsa, OK (US)

( * ) Notice: Subject to any disclaimer, the term of this patent is extended or adjusted under 35 U.S.C. 154(b) by 0 days.

(21) Appl. No.: 10/345,224

(22) Filed: Jan. 16, 2003

(65) Prior Publication Data

US 2003/0188869 A1 Oct. 9, 2003

Related U.S. Application Data

(60) Provisional application No. 60/370,216, filed on Apr. 8, 2002.

(51) Int. Cl.[7] ..... E21B 33/12; E21B 33/124

(52) U.S. Cl. ..... 166/387; 166/188; 166/181; 166/191; 166/325

(58) Field of Search ..... 166/386, 387, 166/188, 181, 119, 191, 133, 313, 325

(56) References Cited

U.S. PATENT DOCUMENTS 3,460,626 A * 8/1969 Ehrlich ..... 166/313
4,648,445 A * 3/1987 Caskey ..... 166/98
4,880,058 A * 11/1989 Lindsey et al. ..... 166/289
5,048,613 A * 9/1991 Shilling ..... 166/387
5,197,547 A * 3/1993 Morgan ..... 166/387
6,513,590 B2 * 2/2003 Allamon et al. ..... 166/181
6,516,886 B2 * 2/2003 Patel ..... 166/313
6,564,876 B2 * 5/2003 Vaynshteyn et al. ..... 166/387
2003/0024712 A1 * 2/2003 Neal et al. ..... 166/386
2003/0183391 A1 * 10/2003 Hriscu et al. ..... 166/305.1

* cited by examiner

*Primary Examiner*—David Bagnell
*Assistant Examiner*—Shane Bomar
(74) *Attorney, Agent, or Firm*—Merek, Blackmon & Voorhees, LLC

(57) ABSTRACT

A method of providing for a single trip removal of packer tools by providing a flapper valve in the upper packer tools which opens when pressure below the tool exceeds the pressure above the tool to allow the tools to be released and allowing flow up the center of the tubing. Additionally, the retrieval tool seals with the stinger tool during removal to allow flow downwardly around the released packer down to the next lower packer and up through the released packer to work only on the next lower packer. The method also contemplates that increased flow circulation will allow forced flow to clear the next lower stinger from sand and other debris to increase the chance of a successful mating of the retrieval tool to the stinger during removal.

7 Claims, 2 Drawing Sheets

FLAPPER VALVE AND ASSOCIATED METHOD FOR SINGLE TRIP RETRIEVAL OF PACKER TOOLS

"This application claims benefit to provisional application 60/370,216, " filed Apr. 8, 2002.

BACKGROUND OF THE INVENTION

A. Field of the Invention

The present invention relates to a novel method and arrangement for setting and retrieving multiple packers in a multi-zone well through the use of a flapper valve to control flow in and through the packers.

B. Description of the Prior Art

It is well known to use packers to isolate various zones of a well. One such arrangement is shown in U.S. Pat. No. 6,315,044 to Tinker, which is incorporated herein by reference. FIGS. 13 and 14 of the Tinker patent show multiple pre-milled "windows" in the casing of the well to facilitate lateral drilling from the main well bore. While shown nearly adjacent to each other in the drawings, these ports can be a great distance from each other, even thousands of feet. It is usually desirable to isolate one zone from another so that operations may be performed on one particular zone, especially when one zone is worked prior to beginning work on the next zone.

One of the difficulties in working wells is the fact that they are subterranean and not directly accessible by the operators of the well. Many methods have been devised to set and release packer tools to isolate zones of a well bore casing. See for instance U.S. Pat. No. 5,197,547 issued Mar. 30, 1993 to Allen B. Morgan. In Morgan, a combination of shear pins, spring tools, and J slots are used to control insertion, setting, and retrieval of the tools. Through sequential release of the shear pins and springs, a top slip body and a lower drag body are moved in contact with a packer body thereby expanding the packers to seal a zone in a well bore. Likewise a series of shear pins or j tools are used to release the packers during sequential trips of the retrieving tool into the wellbore.

The current invention proposes an arrangement and method for perforating multiple zones in a well bore through the use of multiple packers which can be individually (sequentially) released and retrieved in a single trip.

None of the above inventions and patents, taken either singly or in combination, is seen to describe the instant invention as claimed.

SUMMARY OF THE INVENTION

The present invention is accomplished by providing a flapper valve in the packer tool which opens when pressure below the tool exceeds the pressure above the tool to allow the tools to be released and allowing flow up the center of the tubing. Additionally, the retrieval tool seals with the stinger tool during removal to allow flow downwardly around the released packer down to the next lower packer and up through the released packer to work only on the next lower packer.

The present invention also contemplates the sequential release of packers by providing a novel method of releasing the packers. By providing J tools of sequentially larger J slots and alternating the release direction of the J tools, an operator can control the movement of the tubing string to release only a particular packer tool.

Accordingly, it is a principal object of the invention to provide a novel arrangement for a packer tool to facilitate one trip removal of all of the packer tools in one trip.

It is another object of the invention to provide a flapper tool on packer tools to facilitate removal of the tools.

It is a further object of the invention to provided J tools of increasing size between adjacent packer tools and alternating the direction of the J slots to provide sequential control of the packer tools.

Still another object of the invention is to provide a unique arrangement of packer tools to enhance the ease of operation of a multiple zone well.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention to an arrangement and method for tripping multiple packer tools out of a well bore casing in one trip using a flapper valve to control flow through and around the packers and sequentially arranged packers having diverse J tools to aid in sequential removal of the packer tools.

Figure 1:
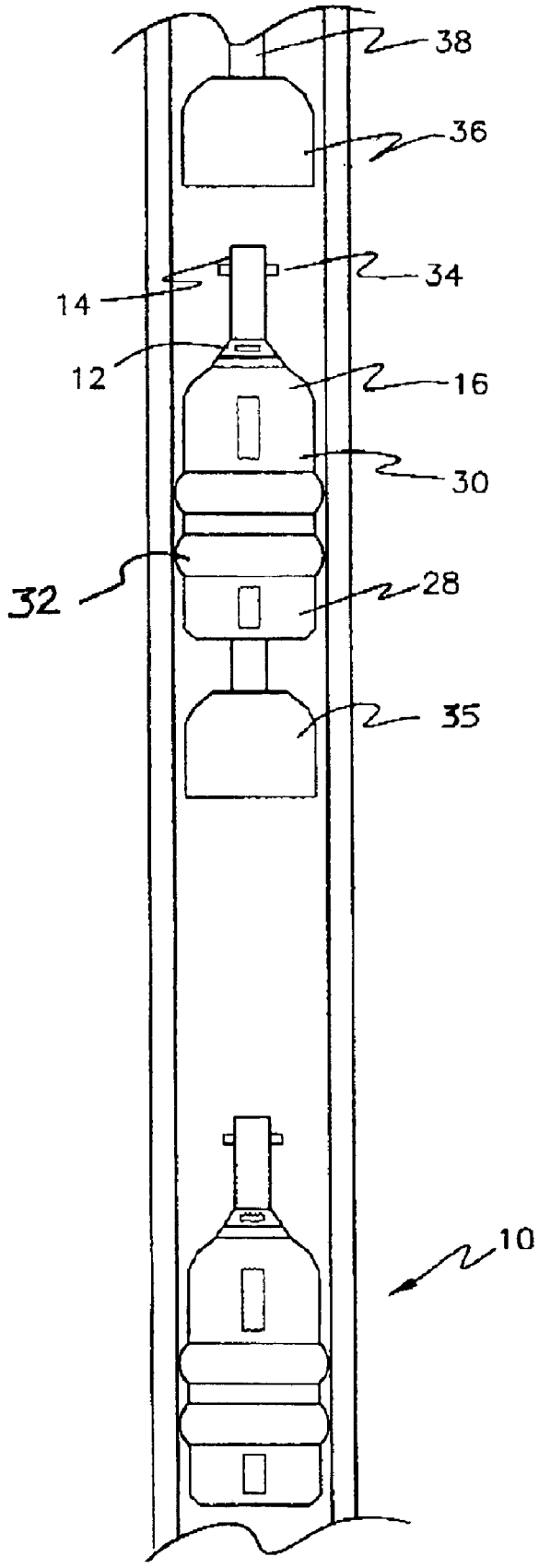
FIG. 1 is a front plan view of the single-trip retrieval packer arrangement according to the present invention.
Figure 2:
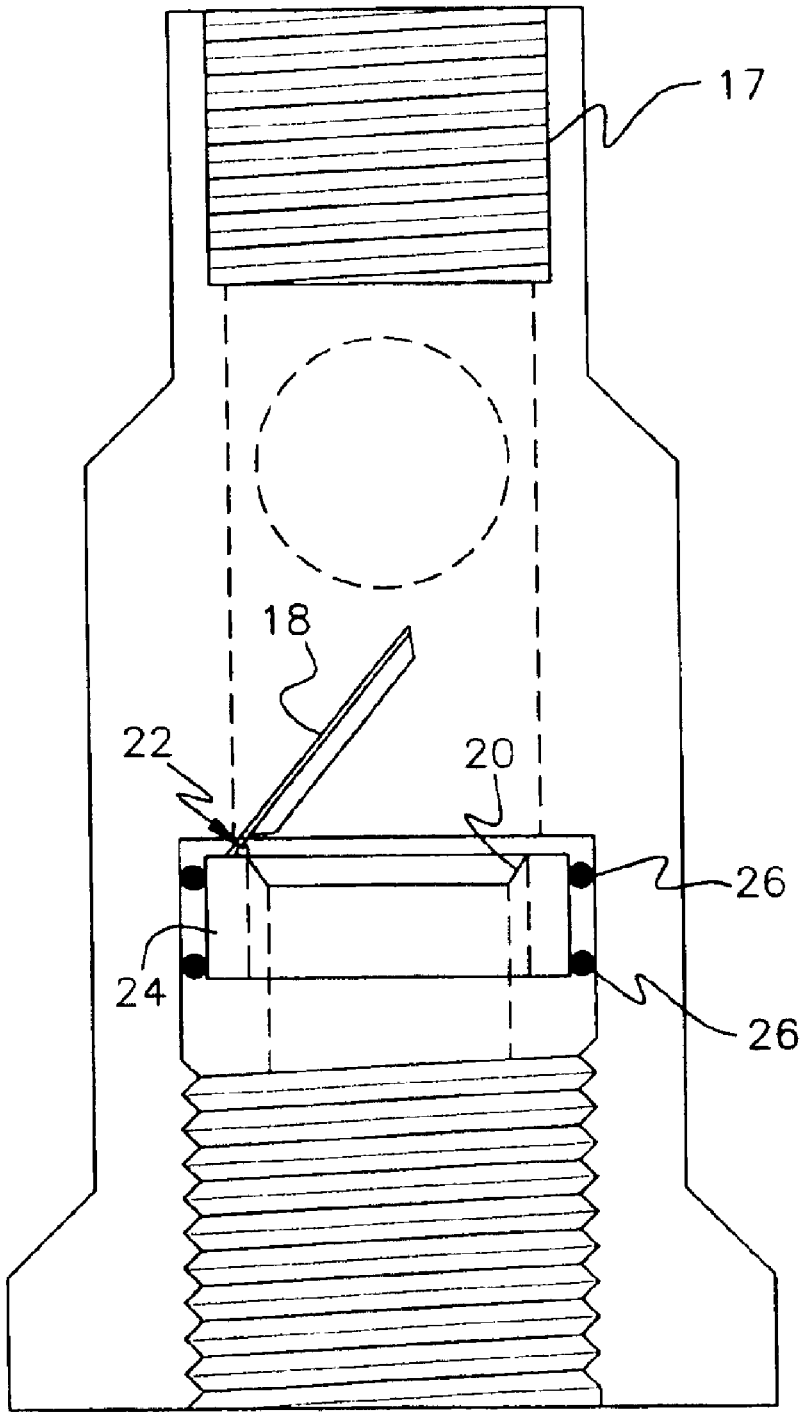
FIG. 2 is a cross-sectional, exploded view of the flapper valve and top sub according to a preferred embodiment of the present invention.

As best explained with reference to the accompanying figures, a packer tool having a flapper valve is shown in FIGS. 1–2. The flapper valve 12 is shown installed between the stinger 14 and the top sub 16, but one skilled in the art would recognize from that the invention could be practiced by installing any one way valve, including a ball valve, at any point along the tubing of the packer tool or in the retriever tools themselves to selectively open a passageway from below the selected packer tool to the surface through the tubing. It is preferred, however, to place the flapper valve in the top sub 16 below where the stinger 14 is threadedly connected to the top sub at 17.

As shown in FIG. 1, the flapper valve is preferably removably seated in an inner chamber of the top sub and is held in place when a mandrel (not shown) is threaded onto the top sub. In this way, the flapper can be removed for cleaning and/or replaced to expedite re-use of the top sub or packer tool.

The flapper valve as is well known consists of a valve seal 18 and a seat 20. The valve is rotatably connected to the base 24 by hinge 22 to a base to allow the seal to move into contact with the seat and out of contact to selectively allow fluids to flow from the bottom of the top sub (i.e., the mandrel) to the top of the top sub (i.e., the stinger). One skilled in the art would recognize that the valve could be cut from a single sheet of flexible material such as rubber with the valve seal 18 formed in the center of the material allowing the seal to hinge about the outer portion of the flexible sheet to eliminate the need for a separate hinge.

If necessary, o-rings 26 can be provide to further seat and secure the flapper valve and to prevent any flow from bypassing the valve 12. Likewise, a stop (not shown) can be provided to limit the upward travel of the flapper valve.

In operation, as shown in FIG. 1, after a casing has been installed in a desired location, a perforating gun (not shown) can be used to perforate the casing at a desire location and depth along the casing. To prepare the area of the well for production, water, acid, or frac sand can be pumped down the casing and out through the perforated zone as necessary and is well known in the art.

Once the zone is prepared for production, a second zone can be prepared for production. A packer tool according to the present embodiment is run into the well and positioned near the zone to be prepared and above the previously prepared zone. The insertion operation of the packer is well known in the art and is recited in the copending application 60/373,309 to Brookey et al. filed Apr. 18, 2002 entitled Patriot Retrievable Production Packer Tool. The top sub 16 and bottom sub 28 carry a number of slips (not shown) which are used to compress the central rubber mandrel expanding packer elements 32 into contact with the casing wall. A J tool is used to prevent the packer elements from contracting by maintaining the top and bottom subs in contact with the ends of the rubber mandrel. But for the purposes of this portion of the invention, the particular type of packer used to seal the first perforation zone from the second perforation zone is not important and should not be used to limit the teaching and scope of the present invention.

Once the packer tool is affixed in place ("packed off") along the casing, a perforating gun can be tripped into the hole and used to perforate the casing at the desired location above the packer tool. Because the well is now sealed at the packer tool, the acid, water or frac sand can be pumped down the well into the second perforated zone without affecting the first perforated zone which is sealed from the second perforated zone by the packer tool. The flapper valve 12, as mentioned above, is a one way valve and hinged to allow only fluids traveling upward in the well and to close and seal when flow proceeds in a downwardly direction. This will effectively prevent the water, acid or frac sand from proceeding past the packer tool. With the flow of the water, acid or frac sand causing the pressure in the casing to increase, the only place for the materials in the casing to go is the perforated zone through the perforations in the casing.

In a like manner, a third perforated zone can be prepared by installing a second packer tool above the second perforated zone and below the desired location of a third perforated zone. The second packer tool will seal the casing above the second packer tool from the casing below the packer tool allowing the operator to work on only the third perforated zone. Unlike the lower packer tool, the second packer tool and any subsequent packer tool must include a retrieving tool 35 to aid in removing the packer tool situated immediately below it. Since the first packer tool is the lowest packer tool, there is no requirement for a retrieval tool 35 on the first packer tool.

This process can be repeated for as many zones as are required or as many zones as the length of the casing allows.

When all of the packer tools have been installed and all of the perforated zones can be prepared, the packer tools can be retrieved. To remove the top most packer tool, a retrieval tool is introduced into the casing. It may be necessary to pump water or similar fluids into the well to clear the top of the packer tool and stinger of sand from frac sand introduced into the well during preparation or other materials created during the perforation and preparation of the well. Since the retrieving tool 36 must slide cleanly over the stinger, pumping the water down the sides of the tubing 38 and back up the interior of the tubing may be necessary before retrieval.

An internal J slot (not shown) on the retrieving tool 36 is sized to mate with the two nipples 34 on opposite sides of the stinger tool as is well known in the art. By setting down the retrieving tool on the stinger, the nipples 34 of the stinger travel upwardly along the slot until they reach the top of the slot. The retrieving tool can then be rotated and lifted to cause the nipple to travel into the J end of the slot, preventing the disengagement of the stinger tool with the retrieving tool as the is lifted bringing the packer tool with it. The slot in the retrieving tool may also be configured to prevent the nipple 34 from realigning with the slot to prevent the stinger and retrieving tool from becoming disengaged as is well known in the art.

As the retrieving tool is manipulated to release the lower sub, the packer elements will contract to release the packer tool as is well known. The entire retrieving tool with the top most packer tool are then lowered to engage the next lower packer tool. With the packer elements 32 contracted, there is relatively little resistance to the downward travel of the packer tool. Water or other fluids can freely travel around the packer tool allowing the packer tool to be lowered without increasing the pressure below the packer tool resisting the downward travel of the tool. Further, because the valve 12 is arranged to open upwardly, the pressure above and below the packer tool can be additionally equalized by allowing fluids to simultaneously flow around the packer tool as discussed above and upwardly through the interior allowing the packer tool to be pushed downwardly by the retrieving tool.

As the upper most packer tool is lowered towards the next lower packer tool, water can be pumped through the casing outside of the tubing and past the upper most packer tool to wash the sand and impediments from around the next lower packer tool to prepare for the removal of the next lower packer tool. The wash water will cycle from the outside of the casing down to the top of the next lower packer tool where it will be stopped from traveling further down by the packer elements 32 of the next lower packer tool and by the flapper valve on the interior of the next lower packer tool. As the water pressure builds from the pumping of the water into the casing, the water will open the flapper valve of the upper most packer tool as water travels upwardly from the next lower packer tool through the retrieving tool 35 of the upper most packer through the mandrel to the top sub. Since the valve is hinged to travel upward, the pressure from below will open the valve and allow the water and entrained sand or other particles to travel upward through the valve opening, through the stinger tool and up through the retrieving tool 36 to the surface if enough water is pumped through.

In this way, without having to trip out the upper most packer tool, the next lower packer tool can be washed with the pumped water for retrieval. In a manner analogous to the upper retrieving tool 36, the upper packer tool retrieving tool 35 can now be lowered onto the stinger of the next lower packer tool and rotated to secure the upper packer tool retrieving tool with the next lower packer tool stinger. The packer elements of the next lower packer tool can then be released by maneuvering the J tool of the next lower packer tool lower sub as is described above and known to those skilled in the art to release the packer elements and free the packer tool.

The same process can then be repeated to release subsequent packer tools until the bottom most packer tool is release and all of the packer tools can be extracted from the casing in one trip. The man-power savings in performing the extraction in one trip is substantial, not to mention increasing the efficiency of exploiting a well through operation in the manner described above.

It is to be understood that the present invention is not limited to the sole embodiment described above, but encompasses any and all embodiments within the scope of the following claims.

I claim:

1. A method of retrieving multiple packer tool in a well in a single trip comprising:

inserting a first packer tool to a predetermined location in a well;

fixing said first packer tool at the predetermined location by expanding at least one packer element on an outer wall of said first packer tool to seal the outer wall of said first packer tool with the well thereby restricting communication around said first packer tool between a first zone below said first packer tool and a second zone immediately above said first packer tool;

providing a first stinger attached to the top of said first packer tool for selectively inserting into a first retrieval tool;

inserting a second packer tool in said well above said first packer tool, said second packer tool having a first internal passage communicating the second zone below said second packer tool with a third zone immediately above said second packer tool within said wellbore;

said second packer tool having a first valve moveably seated in said first internal passage for preventing fluid flow from the third zone immediately above said packer tool to the second zone below said packer tool while continuously allowing fluid flow from the second zone to the third whenever the pressure in the second zone is higher than the third zone;

fixing said second packer tool at the location above said first packer tool by expanding at least one packer element on an outer wall of said second packer tool to seal the outer wall of said second packer tool with the well thereby restricting communication between the third zone and the second zone;

providing said first retrieval tool attached to the bottom of said second packer tool for selectively attaching to said first stinger;

providing a second stinger attached to the top of said second packer tool for receiving a second retrieval tool;

lowering a second retrieval tool into said well until said second retrieval tool contacts said second stinger;

locking said second retrieval tool onto said second stinger;

releasing at least one packer element from said second packer tool to release said second packer tool from said affixed position above said first packer tool;

lowering said second packer element until said first retrieval tool contacts said first stinger;

locking said first retrieval tool onto said first stinger;

releasing at least one packer element from said first packer tool to release said first packer tool from the first packer tool predetermined position.

2. The method of claim 1, further comprising the subsequent step of removing said first packer tool and said second packer tool from said well.

3. The method of claim 1, comprising the further step of raising said second retrieval tool after locking said second retrieval tool to said second stinger, thereby raising said second packer tool and causing the release of at least one packer element on said second packer tool.

4. The method of claim 3, comprising the further step of raising said first retrieval tool after locking said first retrieval tool to said first stinger, thereby raising said first packer tool and causing the release of at least one packer element on said first packer tool.

5. The method of claim 1, wherein said first valve is a one-way valve.

6. A method of retrieving multiple packer tool in a well in a single trip comprising:

inserting a first packer tool to a predetermined location in a well;

fixing said first packer tool at the predetermined location by expanding at least one packer element on an outer wall of said first packer tool to seal the outer wall of said first packer tool with the well thereby restricting communication around said first packer tool between a first zone below said first packer tool and a second zone above said first packer tool;

providing a first stinger attached to the top of said first packer tool for selectively inserting into a first retrieval tool;

inserting a second packer tool in said well above said first packer tool, said second packer tool having a first internal passage communicating the second zone below said second packer tool with a third zone above said second packer tool;

fixing said second packer tool at the location above said first packer tool by expanding at least one packer element on an outer wall of said second packer tool to seal the outer wall of said second packer tool with the well thereby restricting communication between the third zone and the second zone;

providing said first retrieval tool attached to the bottom of said second packer tool for selectively attaching to said first stinger;

providing a second stinger attached to the top of said second packer tool for receiving a second retrieval tool;

lowering a second retrieval tool into said well until said second retrieval tool contacts said second stinger;

locking said second retrieval tool onto said second stinger;

releasing at least one packer element from said second packer tool to release said second packer tool from said affixed position above said first packer tool;

lowering said second packer element until said first retrieval tool contacts said first stinger;

locking said first retrieval tool onto said first stinger;

releasing at least one packer element from said first packer tool to release said first packer tool from the first packer tool predetermined position; and providing the step of introducing fluid into said well third zone around said second packer tool and forcing said fluid up through said first internal passage past a closure mechanism to the third zone prior to lowering said second retrieval tool into contact with said second stinger.

7. A method of retrieving multiple packer tool in a well in a single trip comprising:

inserting a first packer tool to a predetermined location in a well;

fixing said first packer tool at the predetermined location by expanding at least one packer element on an outer wall of said first packer tool to seal the outer wall of said first packer tool with the well thereby restricting communication around said first packer tool between a first zone below said first packer tool and a second zone above said first packer tool;

providing a first stinger attached to the top of said first packer tool for selectively inserting into a first retrieval tool;

inserting a second packer tool in said well above said first packer tool, said second packer tool having a first internal passage communicating the second zone below said second packer tool with a third zone above said second packer tool;

fixing said second packer tool at the location above said first packer tool by expanding at least one packer element on an outer wall of said second packer tool to seal the outer wall of said second packer tool with the well thereby restricting communication between the third zone and the second zone;

providing said first retrieval tool attached to the bottom of said second packer tool for selectively attaching to said first stinger;

providing a second stinger attached to the top of said second packer tool for receiving a second retrieval tool;

lowering a second retrieval tool into said well until said second retrieval tool contacts said second stinger;

locking said second retrieval tool onto said second stinger;

releasing at least one packer element from said second packer tool to release said second packer tool from said affixed position above said first packer tool;

lowering said second packer element until said first retrieval tool contacts said first stinger;

locking said first retrieval tool onto said first stinger;

releasing at least one packer element from said first packer tool to release said first packer tool from the first packer tool predetermined position;

raising said second retrieval tool after locking said second retrieval tool to said second stinger, thereby raising said second packer tool and causing the release of at least one packer element on said second packer tool; and introducing fluid into said well third zone around said second packer tool and forcing said fluid up through said first internal passage past a closure mechanism to the third zone prior to lowering said second retrieval tool into contact with said second stinger.

* * * * *